US005431544A

United States Patent [19]

Hsu et al.

[11] Patent Number: 5,431,544

[45] Date of Patent: Jul. 11, 1995

[54] TILTABLE FAN ASSEMBLY

[75] Inventors: Johnson Hsu, Framingham; Joseph M. Cunning, Cohasset, both of Mass.

[73] Assignee: Holmes Products Corp., Milford, Mass.

[21] Appl. No.: 176,830

[22] Filed: Jan. 3, 1994

[51] Int. Cl.[6] ..... F04D 29/64

[52] U.S. Cl. ..... 416/246; 416/247 R; 415/213.1; 415/214.1; 248/664; 248/676; 403/91

[58] Field of Search ..... 416/100, 246, 247 R; 415/126, 127, 213.1, 214.1; 248/664, 676; 403/84, 91, 100, 101; D23/377, 381, 382

[56] References Cited

U.S. PATENT DOCUMENTS

| | | | |
|---|---|---|---|
| D. 89,076 | 1/1933 | Gosling . | |
| D. 156,494 | 12/1949 | Farr . | |
| D. 172,692 | 7/1954 | Theisen . | |
| D. 294,968 | 3/1988 | Shin-Chin . | |
| D. 304,368 | 10/1989 | Suzuki . | |
| D. 317,199 | 5/1991 | Wang . | |
| D. 323,708 | 2/1992 | Wang . | |
| D. 325,435 | 4/1992 | Coup et al. . | |
| D. 329,089 | 9/1992 | Coup et al. . | |
| D. 336,512 | 6/1993 | Cunning . | |
| 4,732,539 | 3/1988 | Shin-Chin . | |
| 4,867,647 | 9/1989 | Chow | 416/100 |

FOREIGN PATENT DOCUMENTS

| | | | |
|---|---|---|---|
| 0203475 | 9/1923 | United Kingdom | 416/100 |

OTHER PUBLICATIONS

Sales Brochure for Holmes Products Corp. Floor Fan Model No. HAOH-121, published prior to the filing date of the present application.

*Primary Examiner*—Edward K. Look
*Assistant Examiner*—Christopher Verdier
*Attorney, Agent, or Firm*—Kriegsman & Kriegsman

[57] ABSTRACT

A tiltable fan assembly adapted to exhaust air at a variety of angular orientations. In a preferred embodiment, the tiltable fan assembly includes a generally flat base member adapted to rest on a table top or similar surface. The base member is shaped to include a pair of horizontally-extending, cylindrically-shaped sleeves. The fan assembly also includes a pair of mounting posts, each mounting post being angularly adjustably mounted about its longitudinal axis within its respective sleeves and being appropriately sized to extend out through both ends of its respective sleeve. A rotary switch is angularly adjustably mounted on the outer end of one of the mounting posts, and a cap is fixedly mounted on the outer end of the other of the mounting posts. A pair of gaskets are fitted onto the inner ends of the mounting posts. The fan assembly further includes a fan unit and a neck assembly, the neck assembly being used to couple the fan unit to the angularly adjustable mounting posts. The neck assembly preferably includes a pair of neck elements, the first neck element being integrally formed with the fan unit and having a semi-cylindrical bottom portion. The second neck element is semi-cylindrical in shape and fits together with the bottom portion of the first neck element over the inner ends of the pair of mounting posts. The pair of gaskets on the mounting posts serve to mechanically couple the mounting posts to the neck elements.

7 Claims, 6 Drawing Sheets

TILTABLE FAN ASSEMBLY

BACKGROUND OF THE INVENTION

The present invention relates generally to fan assemblies and more particularly to tiltable fan assemblies.

As can readily be appreciated, it is often highly desirable to alter the angular position of a fan unit relative to its associated base so that the flow of air from the fan unit may be accordingly altered to suit one's particular needs.

One type of tiltable fan assembly is disclosed in commonly-assigned U.S. Pat. No. 4,732,539 to Shao Shin-Chin, which issued Mar. 22, 1988. The fan assembly disclosed therein includes a neck joint which is mounted for tilting movement back and forth on the top of an upwardly projecting portion of a base. A fan unit is mounted on top of the neck joint for oscillating movement on the neck joint about a vertical axis. A flexible clip element which serves to selectively limit the extent of the tilting movement of the neck joint is attached to the bottom of the neck joint. The clip element has a hooked shaped tip which will strike the front wall of the upwardly projecting portion of the base when the neck joint is tilted down about 20 degrees from the horizontal axis and as a result prevents further downward tilting movement. However, by manually flexing the clip element upward away from the front wall, the neck joint can be tilted further downward so as to place the fan in a collapsed or folded position.

Another type of tiltable fan assembly is disclosed in commonly assigned, presently-pending U.S. patent application Ser. No. 08/121,933, filed Sep. 15, 1993. The fan assembly described therein includes a stand, a fan unit and a neck joint. The stand comprises a base, an extender pole mounted on the base and a mounting post mounted on the extender pole. The top of the mounting post terminates in upwardly extending bifurcated portions. The fan unit is an oscillating fan unit and includes a set of fan blades enclosed within a front grill and a rear grill, the fan blades, front grill and rear grill being collectively referred to as a fan head. The fan unit is rotatably supported on the neck joint. The bottom of the neck joint is shaped to include a rounded portion which is pivotally mounted between the bifurcated portions of the mounting post. One side of the rounded portion is shaped to include a recessed arc which extends over an angular distance of approximately 90 degrees. An annular boss mounted on the inside surface of one of the bifurcated portions limits the angular movement of the rounded portion relative to the bifurcated portions by abutting the neck joint at opposite ends of the recessed arc. When the boss abuts the neck joint at one end of the recessed arc, the fan head is positioned vertically. When the boss abuts the neck joint at the opposite end of the arc, the fan head is positioned horizontally. To secure the fan head at the aforementioned horizontal and vertical positions and at a plurality of desired locations therebetween, the fan assembly also includes a locking screw which is insertable through the mounting post and the boss and which is used to frictionally engage the arc at a desired position. Embossments are formed on the arc to prevent lateral slippage of the locking screw against the arc during tightening.

Still another type of tiltable fan assembly is exemplified by the POWER FAN® floor fan (Model No. HAOH-199) marketed by the present assignee, Holmes Products Corp. (Milford, Mass.). The aforementioned tan comprises a bracket-type stand having a pair of upwardly extending members. An annularly-shaped collar is mounted between the upwardly extending members and is adapted for tilting movement between a horizontal position and a vertical position. An oscillating fan unit is disposed within the collar, the fan unit being adapted to oscillate relative to the collar and being coupled to the collar for tilting movement.

SUMMARY OF THE INVENTION

It is an object of the present invention to provide a new and novel tiltable fan assembly.

It is another object of the present invention to provide a fan assembly as described above that can be mass produced and assembled easily.

It is still another object of the present invention to provide a fan assembly as described above that has a stable, compact construction.

Additional objects of the invention, as well as features and advantages thereof, will be set forth in part in the description which follows, and in part will be obvious from the description or may be learned by practice of the invention. The objects of the invention also may be realized and attained by means of instrumentalities and combinations particularly pointed out in the appended claims.

In accordance with the purpose of the present invention as broadly set forth herein, a tiltable fan assembly constructed in accordance with the teachings of the present invention is provided herein, the tiltable fan assembly comprising in a preferred embodiment a generally flat base member adapted to rest on a table top or similar surface. The base member is shaped to include a pair of horizontally-extending, cylindrically-shaped sleeves. The fan assembly also comprises a pair of mounting posts, each mounting post being angularly adjustably mounted about its longitudinal axis within its respective sleeves and being appropriately sized to extend out through both ends of its respective sleeve. A rotary switch is angularly adjustably mounted on the outer end of one of the mounting posts, and a cap is fixedly mounted on the outer end of the other of the mounting posts. A pair of gaskets are fitted onto the inner ends of the mounting posts. The fan assembly further comprises a fan unit and a neck assembly, the neck assembly being used to couple the fan unit to the angularly adjustable mounting posts. The neck assembly preferably comprises a pair of neck elements, the first neck element being integrally formed with the fan unit and having a semi-cylindrical bottom portion. The second neck element is semi-cylindrical in shape and fits together with the bottom portion of the first neck element over the inner ends of the pair of mounting posts. The pair of gaskets on the mounting posts serve to mechanically couple the mounting posts to the neck elements.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
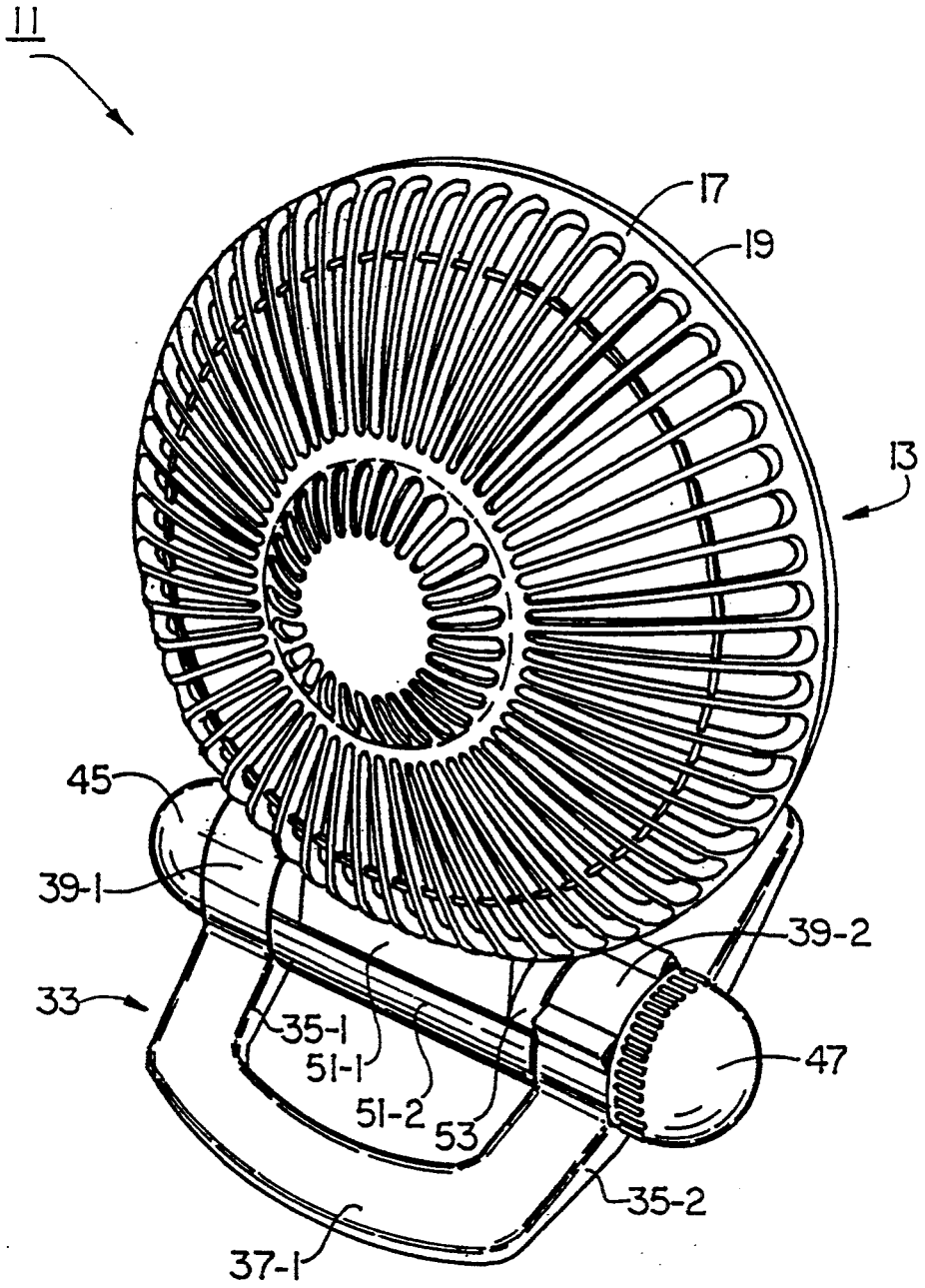
FIG. 1 is a front, top, right perspective view of one embodiment of a tiltable fan assembly constructed according to the teachings of the present invention.

Referring now to the drawings, there are shown various views of one embodiment of a tiltable fan assembly constructed according to the teachings of the present invention, the tiltable fan assembly being represented generally by reference numeral 11. Those parts of tiltable fan assembly 11 not pertinent to the present invention (e.g., electrical wiring) are not shown or discussed for purposes of clarity and simplicity.

Figure 2:
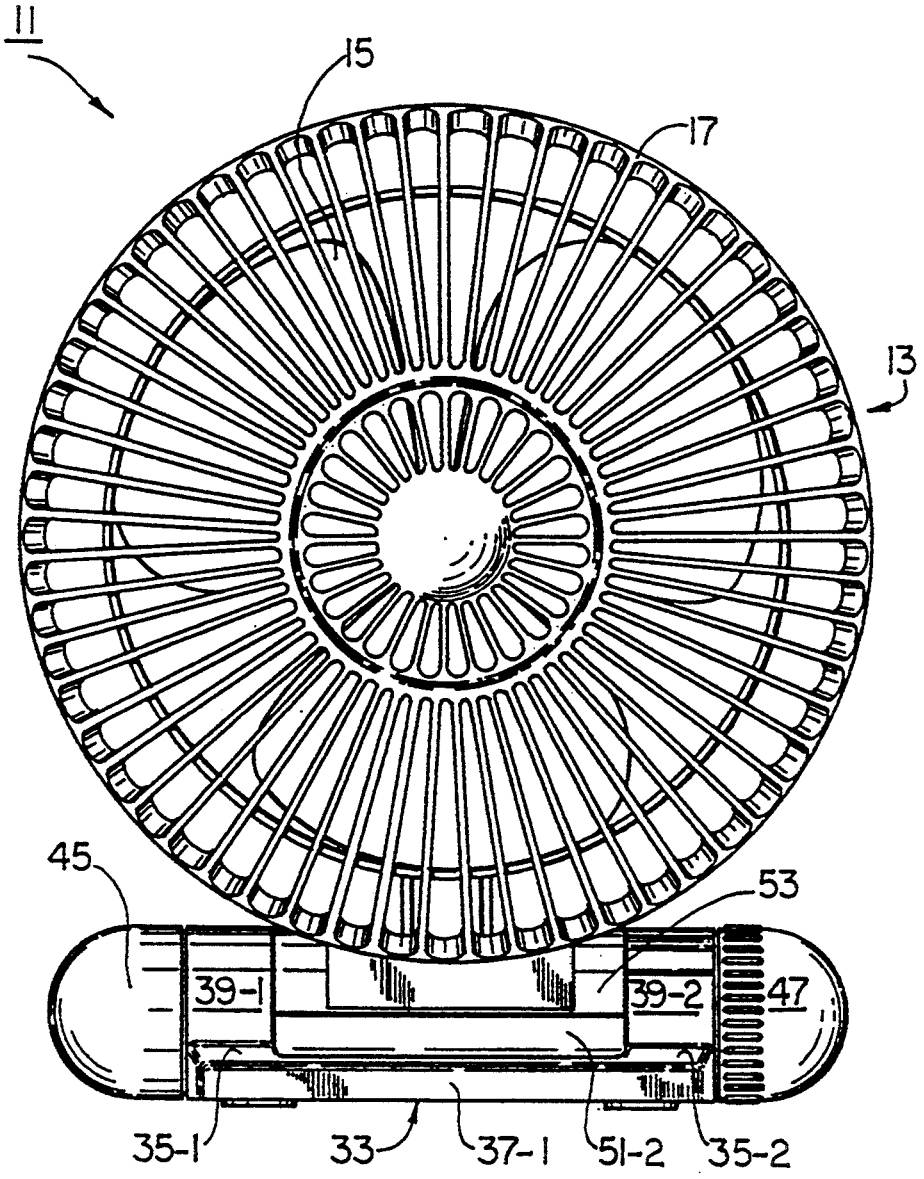
FIG. 2 is a front view of the tiltable fan assembly shown in FIG. 1.
Figure 3:
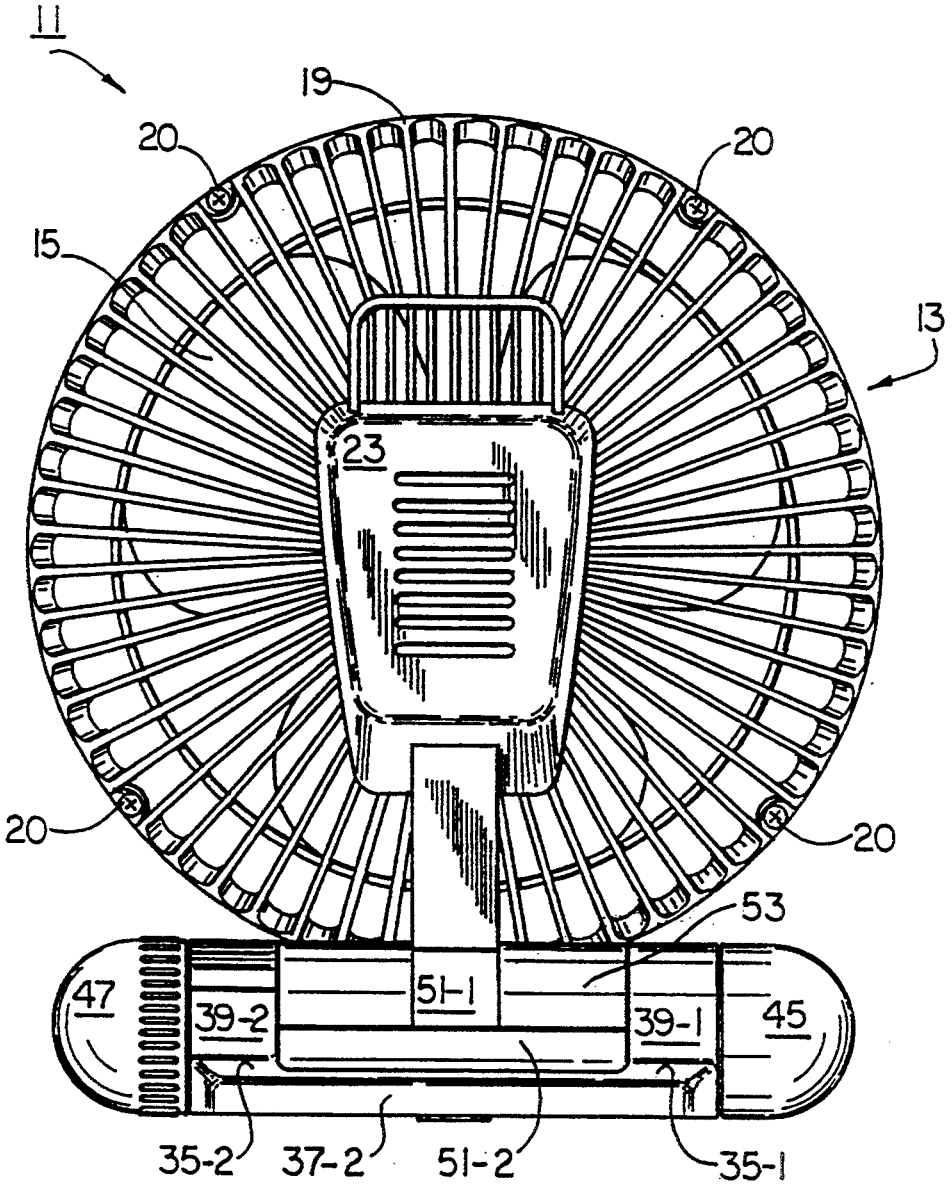
FIG. 3 is a rear view of the tiltable fan assembly shown in FIG. 1.

Fan assembly 11 includes a fan unit 13. Fan unit 13 includes a set of fan blades 15 (see FIGS. 2 and 3), blades 15 being encased within a housing comprising a front grill 17 and a rear grill 19. Grills 17 and 19 are secured to one another with a plurality of screws 20. Fan blades 15 are mounted on a shaft (not shown) which is connected to the drive shaft of a fan motor (also not shown) encased within a motor housing 23.

Fan assembly 11 also includes a base member 33 adapted to sit on a table top or other similar surface. Base member 33, which is preferably a unitary structure made from molded plastic, is shaped to include a pair of generally parallel leg portions 35-1 and 35-2 and a pair of transverse portions 37-1 and 37-2, transverse portions 37-1 and 37-2 interconnecting the adjacent ends of leg portions 35-1 and 35-2 to form a generally oval-shaped, closed-loop structure. The respective midportions of leg portions 35-1 and 35-2 are shaped to form a pair of transverse, open-ended, horizontally-extending, cylindrical sleeves 39-1 and 39-2.

Fan assembly 11 further includes a pair of tubular mounting posts 41-1 and 41-2 mounted within sleeves 39-1 and 39-2, respectively. Each post 41 is angularly adjustably mounted about its longitudinal axis in its respective sleeve 39 and is appropriately sized to extend out through both ends of its respective sleeve 39. A pair of gaskets 43-1 and 43-2 are fixedly mounted on the inner ends of posts 41-1 and 41-2, respectively, for use in frictionally engaging a pair of neck elements of the type to be hereinafter described. A cap 45 is fixedly mounted on the outer end of post 41-1. A three position (OFF-HI-LO) rotary switch 47 is adjustably mounted on the outer end of post 41-2.

Fan assembly 11 further includes means for coupling fan unit 13 to mounting posts 41-1 and 41-2. In the present embodiment, said coupling means comprises a pair of neck elements 51-1 and 51-2. Neck element 51-1, which is integrally formed with rear grill 19 and housing 23 of unit 13, has a semi-cylindrical bottom portion 53. Neck element 51-2 is also semi-cylindrical in shape and may be joined to bottom portion 53 of neck element 51-1 by means of a pair of screws 55-1 and 55-2. When fan assembly 11 is fully assembled, neck element 51-2 and bottom portion 53 of neck element 51-1 are joined together by screws 55 and fit over the inner ends of posts 41-1 and 41-2. In this manner, neck elements 51-1 and 51-2 are mechanically coupled to posts 41-1 and 41-2 via gaskets 43-1 and 43-2.

Figure 4:
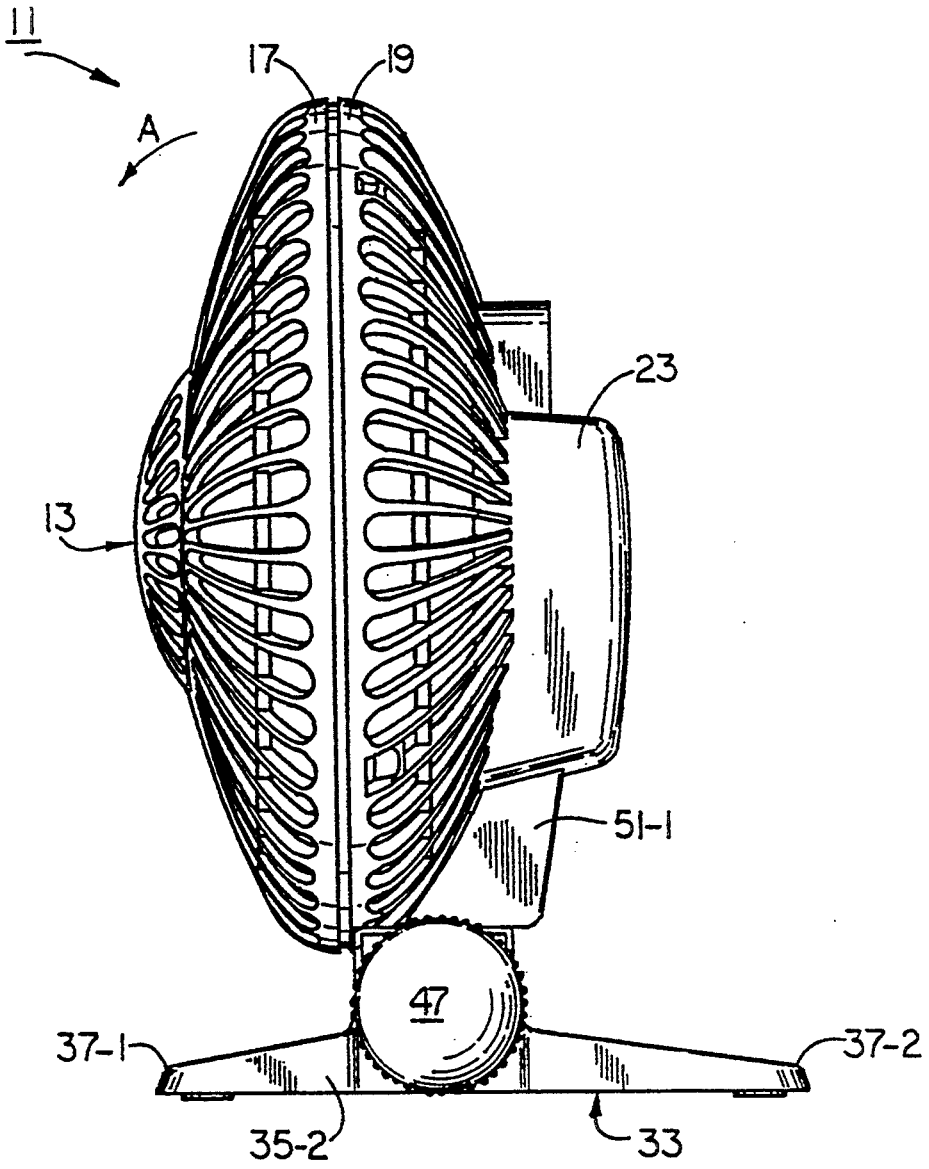
FIG. 4 is a right side view of the tillable fan assembly shown in FIG. 1, the arrow A indicating a direction in which the fan unit may be adjustably tilted relative to the base member.
Figure 5:
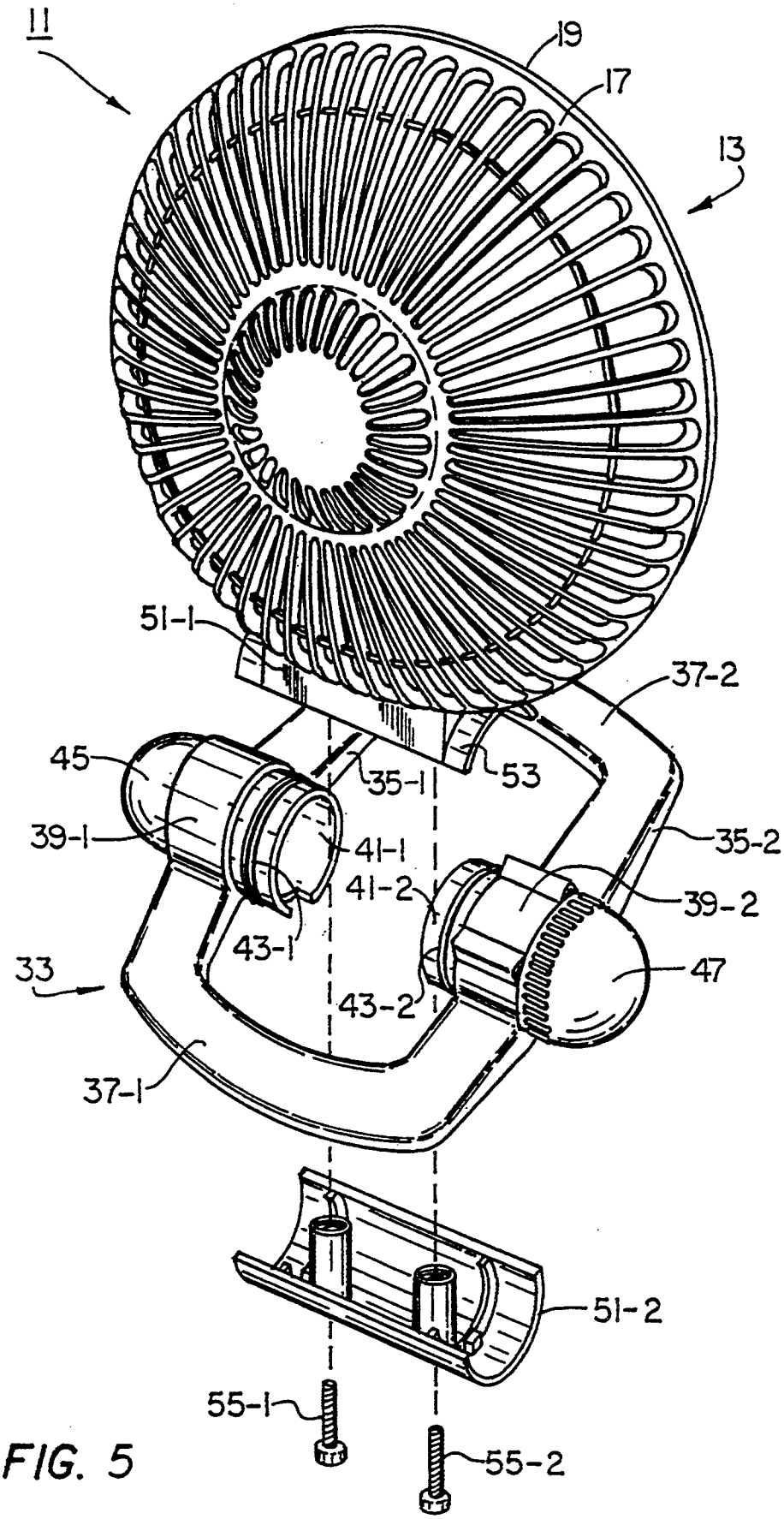
FIG. 5 is a partially exploded perspective view of the tiltable fan assembly shown in FIG. 1.
Figure 6:
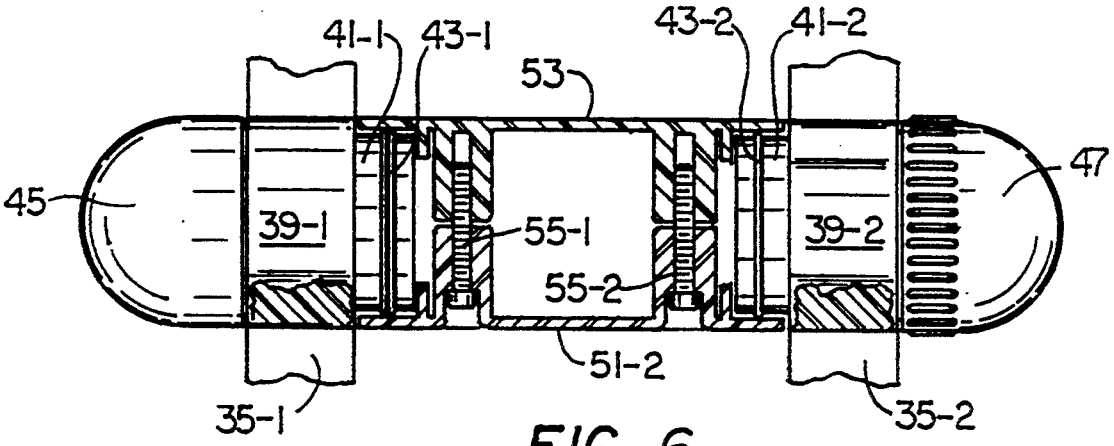
FIG. 6 is a fragmentary bottom view, shown partly in section, of the tiltable fan assembly shown in FIG. 1, the fan unit not being shown for purposes of clarity and simplicity.

To adjust the angular orientation of fan unit 13 relative to base member 33 in the manner shown in FIG. 4, one merely applies sufficient force to fan unit 13 in the direction indicated by arrow A to cause neck elements 51-1 and 51-2 to pivot counterclockwise (as viewed in FIG. 4) relative to base member 33 while keeping base member 33 stationary.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tiltable fan assembly comprising:

(a) a base member adapted to sit on a table top or similar surface, said base member being shaped to include a pair of horizontally-extending sleeves;

(b) a pair of mounting posts, each of said mounting posts extending horizontally within one of said pair of horizontally-extending sleeves and being angularly adjustably mounted about its longitudinal axis within its respective horizontally-extending sleeve;

(c) a fan unit; and (d) means for mechanically coupling said fan unit to said pair of mounting posts.

2. The tiltable fan assembly as claimed in claim 1 wherein said base member is a unitary structure shaped to include a pair of generally parallel, horizontally-extending leg portions and a pair of horizontally-extending transverse portions, said pair of transverse portions interconnecting the adjacent ends of said pair of generally parallel leg portions to form a generally oval-shaped, closed-loop structure, said pair of horizontally-extending sleeves being formed in said pair of generally parallel, horizontally-extending leg portions.

3. The tiltable fan assembly as claimed in claim 1 further comprising a rotary switch angularly adjustably mounted on the end of one of said mounting posts.

4. A tiltable fan assembly comprising:

(a) a base member adapted to sit on a table top or similar surface, said base member being shaped to include a pair of generally parallel, horizontally-extending leg portions, said generally parallel, horizontally-extending leg portions being shaped to form a pair of transverse, horizontally-extending sleeves;

(b) a pair of mounting posts, each of said mounting posts extending: horizontally through one of said transverse, horizontally-extending sleeves and being angularly adjustably mounted about its longitudinal axis within its respective transverse, horizontally-extending sleeve;

(c) a fan unit; and (d) a neck assembly fixed to said fan unit and mechanically coupled to said pair of mounting posts for angular adjustment therewith.

5. A tiltable fan assembly comprising:

(a) a base member adapted to sit on a table top or similar surface, said base member being shaped to include a pair of generally parallel leg portions, the respective midportions of said generally parallel leg portions being shaped to form a pair of transverse, horizontally-extending sleeves;

(b) a pair of mounting posts, each of said mounting posts extending horizontally through the inner end of one of said transverse, horizontally-extending sleeves and being angularly adjustably mounted about its longitudinal axis within its respective transverse, horizontally-extending sleeve;

(c) a fan unit; and (d) a neck assembly fixed to said fan unit and mechanically coupled to said pair of mounting posts for angular adjustment therewith, said neck assembly comprising a first neck element and a second neck element, said first neck element being integrally formed with said fan unit, said first neck element and said second neck element being fitted together and fixed to the inner ends of said pair of mounting posts.

6. The tiltable fan assembly as claimed in claim 5 wherein said mounting posts are cylindrical in shape and wherein said first neck element includes a semi-cylindrical bottom portion and wherein said second neck element is semi-cylindrical in shape.

7. The tiltable fan assembly as claimed in claim 4 further comprising a rotary switch angularly adjustably mounted on one of said mounting posts.

* * * * *